US011987909B2

(12) United States Patent
Lau

(10) Patent No.: US 11,987,909 B2
(45) Date of Patent: May 21, 2024

(54) FABRICS HAVING IMPROVED MOISTURE TRANSPORT PROPERTIES

(71) Applicant: COMFIKNIT LIMITED, Kowloon (HK)

(72) Inventor: Chun Kee Lau, Kowloon (HK)

(73) Assignee: COMFIKNIT LIMITED, Hong Kong (HK)

( * ) Notice: Subject to any disclaimer, the term of this patent is extended or adjusted under 35 U.S.C. 154(b) by 0 days.

(21) Appl. No.: 17/268,094

(22) PCT Filed: May 26, 2020

(86) PCT No.: PCT/AU2020/050523
§ 371 (c)(1),
(2) Date: Feb. 12, 2021

(87) PCT Pub. No.: WO2020/237301
PCT Pub. Date: Dec. 3, 2020

(65) Prior Publication Data

US 2021/0246582 A1 Aug. 12, 2021

(30) Foreign Application Priority Data

May 27, 2019 (AU) ..... 2019901800

(51) Int. Cl.
*D03D 15/47* (2021.01)
*D02G 3/04* (2006.01)
(Continued)

(52) U.S. Cl.
CPC ..... *D03D 11/00* (2013.01); *D02G 3/045* (2013.01); *D03D 13/004* (2013.01);
(Continued)

(58) Field of Classification Search
CPC .... D03D 15/283; D03D 15/225; D03D 15/56; D03D 15/47
See application file for complete search history.

(56) References Cited

U.S. PATENT DOCUMENTS 7,682,994 B2 * 3/2010 Van Emden ..... D03D 15/00 442/181
7,816,288 B2 * 10/2010 Leonard ..... A01N 25/34 442/208
(Continued)

FOREIGN PATENT DOCUMENTS

CN 205295630 U 6/2016
CN 106192177 A 12/2016
(Continued)

OTHER PUBLICATIONS

International Search Report mailed Aug. 3, 2020 in corresponding PCT International Application No. PCT/AU2020/050523.
(Continued)

*Primary Examiner* — Jenna L Johnson
(74) *Attorney, Agent, or Firm* — OSTROLENK FABER LLP

(57) ABSTRACT

The present invention provides a fabric comprising or consisting of: a first yarn comprising a fiber blend of modal and polyester; a second yarn comprising spandex; and a third yarn comprising polyester. The polyester in the fiber blend may have a cross-section such as X-shape, M-shape, I-shape, honeycomb-shape, Y-shape, U-shape or O-shape that creates a plurality of spaces along the length of the first yarn that facilitate a capillary action. The modal in the fiber blend may have a cross-section that is substantially rectangular.

37 Claims, 17 Drawing Sheets

(51) Int. Cl.

| | |
|---|---|
| ***D03D 11/00*** | (2006.01) |
| ***D03D 13/00*** | (2006.01) |
| ***D03D 15/225*** | (2021.01) |
| ***D03D 15/283*** | (2021.01) |
| ***D03D 15/44*** | (2021.01) |
| ***D04B 1/04*** | (2006.01) |
| ***D04B 1/16*** | (2006.01) |
| ***D04B 1/18*** | (2006.01) |
| *A41D 31/102* | (2019.01) |

(52) U.S. Cl.

CPC ..... *D03D 15/225* (2021.01); *D03D 15/283* (2021.01); *D03D 15/44* (2021.01); *D03D 15/47* (2021.01); *D04B 1/04* (2013.01); *D04B 1/16* (2013.01); *D04B 1/18* (2013.01); *A41D 31/102* (2019.02); *D10B 2201/20* (2013.01); *D10B 2331/04* (2013.01); *D10B 2331/06* (2013.01); *D10B 2401/022* (2013.01); *D10B 2501/04* (2013.01)

(56) References Cited

U.S. PATENT DOCUMENTS

| | | | | |
|---|---|---|---|---|
| 2005/0202741 | A1 | 9/2005 | Onodera et al. | 442/189 |
| 2016/0353810 | A1 | 12/2016 | Barnes et al. | |
| 2017/0145596 | A1 | 5/2017 | Hays et al. | |
| 2019/0106816 | A1 | 4/2019 | Beagle et al. | |
| 2020/0131697 | A1* | 4/2020 | Wong | D04B 21/207 |

FOREIGN PATENT DOCUMENTS

| | | | |
|---|---|---|---|
| CN | 206663908 | U | 11/2017 |
| CN | 107904762 | A | 4/2018 |
| WO | WO 2019/036783 | A1 | 2/2019 |

OTHER PUBLICATIONS

Written Opinion mailed Aug. 3, 2020 in corresponding PCT International Application No. PCT/AU2020/050523.

* cited by examiner

FABRICS HAVING IMPROVED MOISTURE TRANSPORT PROPERTIES

CROSS-REFERENCE TO RELATED APPLICATIONS

The present application is a 35 U.S.C. §§ 371 national phase conversion of PCT/AU2020/050523, filed May 26, 2020, which claims priority to Australian Patent Application No. 2019901800, filed May 27, 2019, the contents of which are incorporated herein by reference. The PCT International Application was published in the English language.

FIELD OF THE INVENTION

The present invention relates generally to fabrics having improved moisture transport properties and to the use thereof in items of clothing and home textiles.

BACKGROUND OF THE INVENTION

Any discussion of the prior art throughout this specification should in no way be considered as an admission that such prior art is widely known or forms part of the common general knowledge in the field.

Fast-drying clothing is becoming increasingly popular in areas such as sport, recreation and outdoor occupations where wearers of the clothing produce large volumes of perspiration. Fabrics used in fast-drying clothing work by wicking perspiration from the skin to the outer surface of the fabric where evaporation takes place.

The present inventor has developed improved fabrics suitable for use in fast-drying clothing applications which are able to rapidly absorb and efficiently transport perspiration to the outer surface of the clothing.

SUMMARY OF THE INVENTION

In a first aspect the present invention provides a fabric comprising or consisting of:

- a first yarn comprising a fiber blend of modal and polyester;
- a second yarn comprising spandex; and
- a third yarn comprising polyester.

The first yarn may consist of a fiber blend of modal and polyester.

The first yarn may be a spun yarn.

The spun yarn may be a spun yarn of between 40 and 70 single counts.

The spun yarn may be a spun yarn of between 55 and 65 single counts.

The spun yarn may be a spun yarn of 50 or 60 single counts.

The polyester may be present in the fiber blend in an amount between about 65% and about 95% by weight and the modal may be present in the fiber blend in an amount between about 5% and about 35% by weight.

The polyester may be present in the fiber blend in an amount between about 75% and about 95% by weight and the modal may be present in the fiber blend in an amount between about 5% and about 25% by weight.

The polyester may be present in the fiber blend in an amount between about 85% and about 95% by weight and the modal may be present in the fiber blend in an amount between about 5% and about 15% by weight.

The polyester may be present in the fiber blend in an amount between about 80% and about 90% by weight and the modal may be present in the fiber blend in an amount between about 10% and about 20% by weight.

The polyester may be present in the fiber blend in an amount of about 84% by weight and the modal may be present in the fiber blend in an amount of about 16% by weight.

The polyester in the fiber blend may have a cross-section that creates a plurality of spaces along the length of the first yarn that facilitate a capillary action.

The polyester in the fiber blend may have a cross-section that is X-shaped, M-shaped, I-shaped, honeycomb-shaped, Y-shaped, U-shaped or O-shaped, thereby creating a plurality of spaces along the length of the first yarn that facilitate a capillary action.

The polyester in the fiber blend may have a cross-section that is X-shaped thereby creating a plurality of spaces along the length of the first yarn that facilitate a capillary action.

The modal in the fiber blend may have a cross-section that is substantially rectangular.

The polyester and modal in the fiber blend may be of staple length.

The first yarn may comprise between about 45% and about 75% by weight of the fabric.

The first yarn may comprise between about 55% and about 65% by weight of the fabric.

The first yarn may comprise about 60% to 61% by weight of the fabric.

The second yarn may be a filament yarn.

The second yarn may comprise or consist of 100% spandex.

The spandex of the second yarn may be between about 20-denier and about 70-denier.

The spandex of the second yarn may be between about 15-denier and about 35-denier.

The spandex of the second yarn may be between about 20-denier and about 30-denier.

The spandex of the second yarn may be about 20-denier or about 30-denier.

The second yarn may comprise between about 4% and about 12%, or between about 2.5% and about 10% by weight of the fabric.

The second yarn may comprise about 5% by weight of the fabric.

The third yarn may be a filament yarn.

The third yarn may comprise or consist of 100% polyester.

The polyester of the third yarn may be between about 20-denier and about 80-denier.

The polyester of the third yarn may be between about 45-denier and about 55-denier.

The polyester of the third yarn may be 50-denier.

The third yarn may comprise between about 20% and about 50% by weight of the fabric.

The third yarn may comprise between about 30% and about 40% by weight of the fabric.

The third yarn may comprise about 34% to 35% by weight of the fabric.

The second yarn may be inter-knitted between the first yarn and the third yarn.

The first, second and third yarns may be present as layers.

The first yarn may form a bottom layer, the second yarn may form a middle layer and the third yarn may form a top layer.

The fabric may consist of three layers.

The fabric may be a single jersey, pique, pointelle, double knit, jacquard or terry.

In an embodiment of the first aspect the present invention provides a fabric comprising or consisting of:

- a bottom yarn which is a spun yarn of 60 single counts comprising or consisting of a fiber blend of about 16% by weight modal and about 84% by weight polyester;
- a middle yarn which is a filament yarn comprising or consisting of 20-denier 100% spandex; and
- a top yarn which is a filament yarn comprising or consisting of 50-denier 100% polyester, and wherein the polyester in the fiber blend has a cross-section that is X-shaped, M-shaped, I-shaped, honeycomb-shaped, Y-shaped, U-shaped or O-shaped, thereby creating a plurality of spaces along the length of the bottom yarn that facilitates a capillary action.

In this embodiment the top yarn may comprise about 35% by weight of the fabric, the middle yarn may comprise about 5% by weight of the fabric, and the bottom yarn may comprise about 60% by weight of the fabric.

In this embodiment the fabric may be a single jersey.

In another embodiment of the first aspect the present invention provides a fabric comprising or consisting of:

- a bottom yarn which is a spun yarn of 60 single counts comprising or consisting of a fiber blend of about 16% by weight modal and about 84% by weight polyester;
- a middle yarn which is a filament yarn comprising or consisting of 30-denier 100% spandex; and
- a top yarn which is a filament yarn comprising or consisting of 50-denier 100% polyester,
- and wherein the polyester in the fiber blend has a cross-section that is X-shaped, M-shaped, I-shaped, honeycomb-shaped, Y-shaped, U-shaped or O-shaped, thereby creating a plurality of spaces along the length of the bottom yarn that facilitates a capillary action.

In this embodiment the top yarn may comprise about 35% by weight of the fabric, the middle yarn may comprise about 5% by weight of the fabric, and the bottom yarn may comprise about 60% by weight of the fabric.

In this embodiment the fabric may be a pique.

In another embodiment of the first aspect the present invention provides a fabric comprising or consisting of:

- a bottom yarn which is a spun yarn of 60 single counts comprising or consisting of a fiber blend of about 16% modal and about 84% polyester;
- a middle yarn which is a filament yarn comprising or consisting of 20-denier 100% spandex; and
- a top yarn which is a filament yarn comprising or consisting of 50-denier 100% polyester,
- and wherein the polyester in the fiber blend has a cross-section that is X-shaped, M-shaped, I-shaped, honeycomb-shaped, Y-shaped, U-shaped or O-shaped, thereby creating a plurality of spaces along the length of the bottom yarn that facilitates a capillary action.

In this embodiment the top yarn may comprise about 34.5% by weight of the fabric, the middle yarn may comprise about 5% by weight of the fabric, and the bottom yarn may comprise about 60.5% by weight of the fabric.

In this embodiment the fabric may be a pointelle.

In yet another embodiment of the first aspect the present invention provides a fabric comprising or consisting of:

- a bottom yarn which is a spun yarn of 50 single counts comprising or consisting of a fiber blend of about 9% modal and about 91% polyester;
- a middle yarn which is a filament yarn comprising or consisting of 20-denier 100% spandex; and
- a top yarn which is a filament yarn comprising or consisting of 50-denier 100% polyester,
- and wherein the polyester in the fiber blend has a cross-section that is X-shaped, M-shaped, I-shaped, honeycomb-shaped, Y-shaped, U-shaped or O-shaped, thereby creating a plurality of spaces along the length of the bottom yarn that facilitates a capillary action.

In this embodiment the top yarn may comprise about 30.4% by weight of the fabric, the middle yarn may comprise about 4.7% by weight of the fabric, and the bottom yarn may comprise about 61.9% by weight of the fabric.

In this embodiment the fabric may be a jersey.

In a second aspect the present invention provides an article of clothing or a home textile when produced from the fabric of the first aspect.

The clothing may be a shirt, singlet, jersey, pyjamas, maillot, fleece, shorts, pants, hood, running hat, skull cap, helmet liner, mask, headband or socks.

The home textile may be towels, bedding, cushions, sofa or furniture.

Definitions

Throughout this specification, unless the context requires otherwise, the word "comprise", or variations such as "comprises" or "comprising", will be understood to imply the inclusion of a stated element, integer or step, or group of elements, integers or steps, but not the exclusion of any other element, integer or step, or group of elements, integers or steps. Thus, in the context of this specification, the term "comprising" means "including principally, but not necessarily solely".

In the context of this specification the terms "a" and "an" are used herein to refer to one or to more than one (i.e to at least one) of the grammatical object of the article. By way of example, "an element" means one element or more than one element.

The term "about" is understood to refer to a range of numbers that a person of skill in the art would consider equivalent to the recited value in the context of achieving the same function or result.

In the context of this specification the term "yarn" is understood to mean a continuous length of interlocked fibers that can be made into a textile material.

In the context of this specification the term "filament yarn" is understood to mean a yarn made of one or more continuous fibers in the form of filaments in which each filament runs the entire length of the yarn.

In the context of this specification the term "spun yarn" is understood to mean staple-length fibers twisted or spun together to form a continuous strand.

In the context of this specification the term "staple length" refers to the average length of a group of fibers and is dependent on the origin of the fibers. Natural fibers such as cotton or wool have a range of lengths in each staple and therefore the staple length is an average. In the case of synthetic fibers which are cut to a certain length, the staple length is the same for every fiber.

In the context of this specification the term "denier" refers to a unit of measurement for the linear mass density of fibers defined as mass (in grams) per 9000 meters of the fiber.

BRIEF DESCRIPTION OF DRAWINGS

Embodiments of the invention will now be described by way of example only with reference to the accompanying drawings, in which.

DETAILED DESCRIPTION

Figure 1:
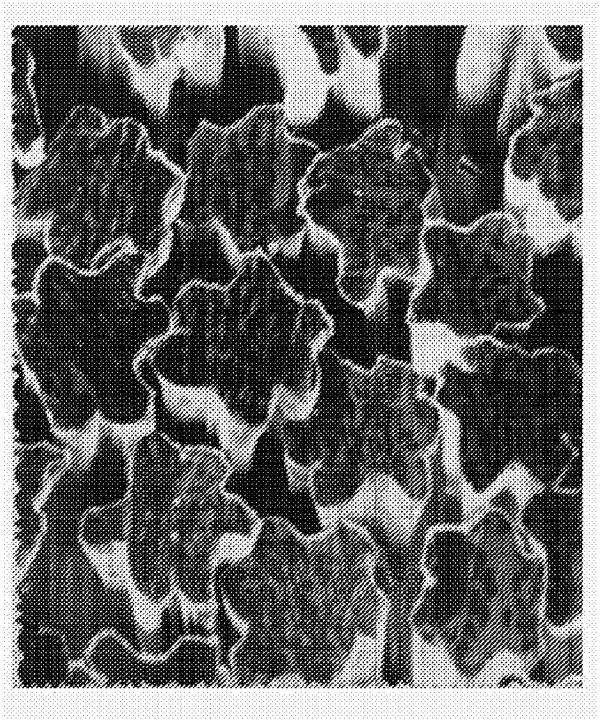
FIG. 1: Microscopic image with 100× magnification of polyester fibers having an M-shaped cross-section.
Figure 2:
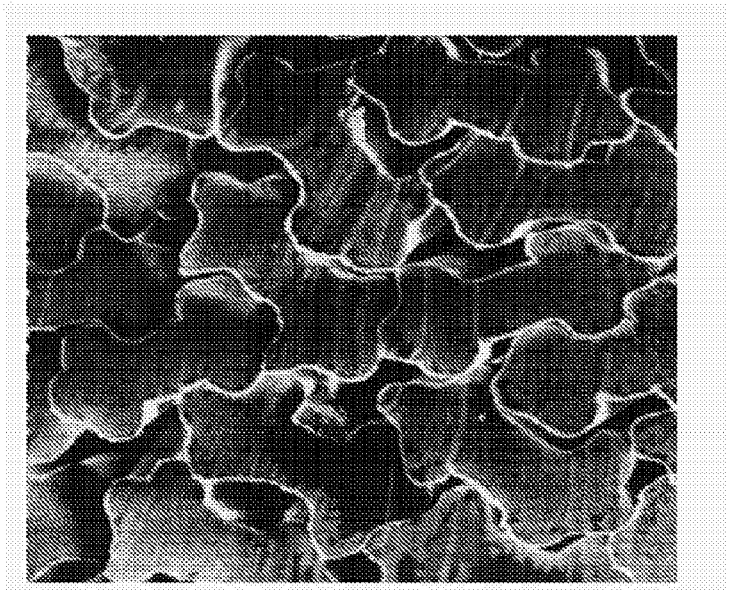
FIG. 2: Microscopic image with 100× magnification of polyester fibers having an I-shaped cross-section.
Figure 3:
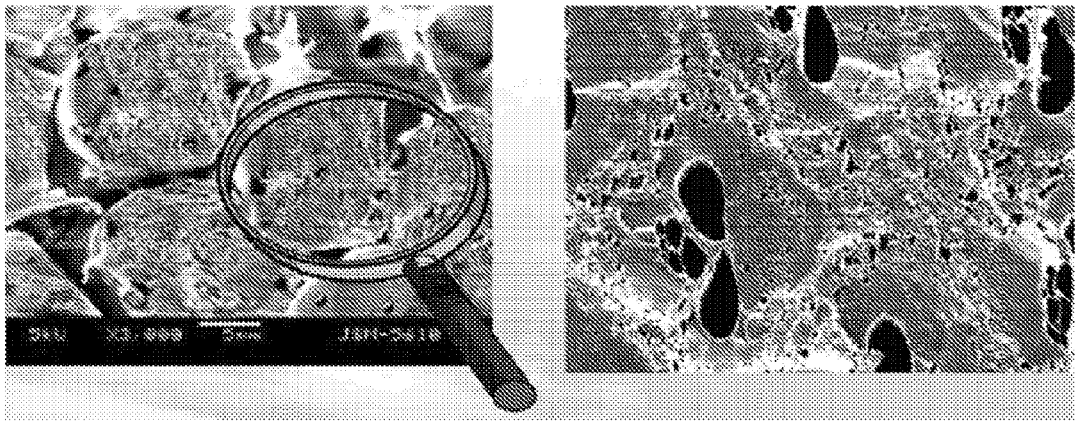
FIG. 3: Microscopic image with 100× magnification of polyester fibers having a honeycomb-shaped cross-section.
Figure 4:
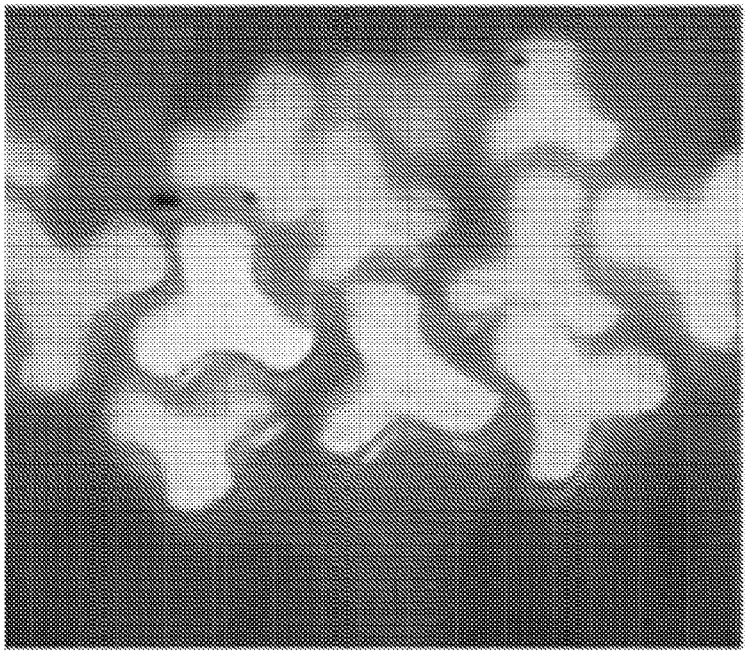
FIG. 4: Microscopic image with 100× magnification of polyester fibers having a Y-shaped cross-section.
Figure 5:
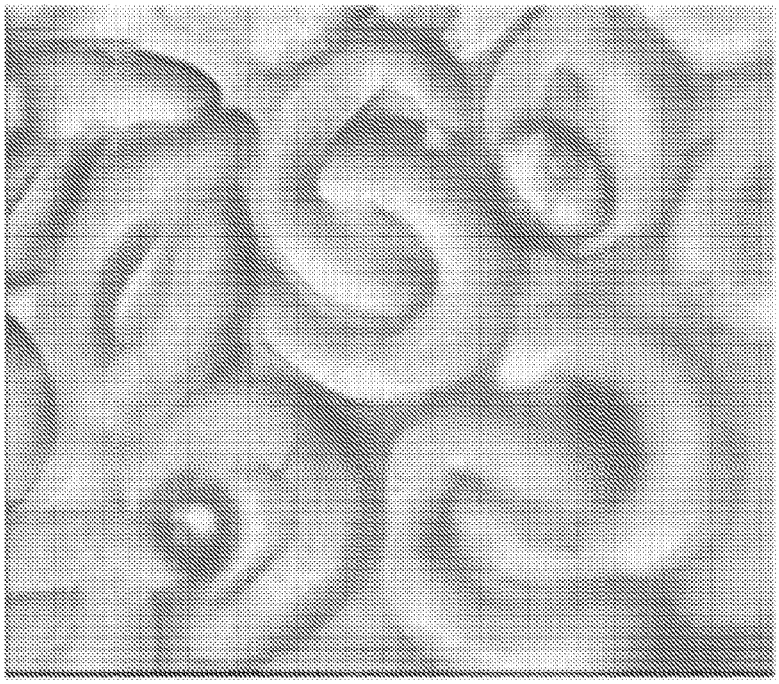
FIG. 5: Microscopic image with 100× magnification of polyester fibers having a U-shaped cross-section.
Figure 6:
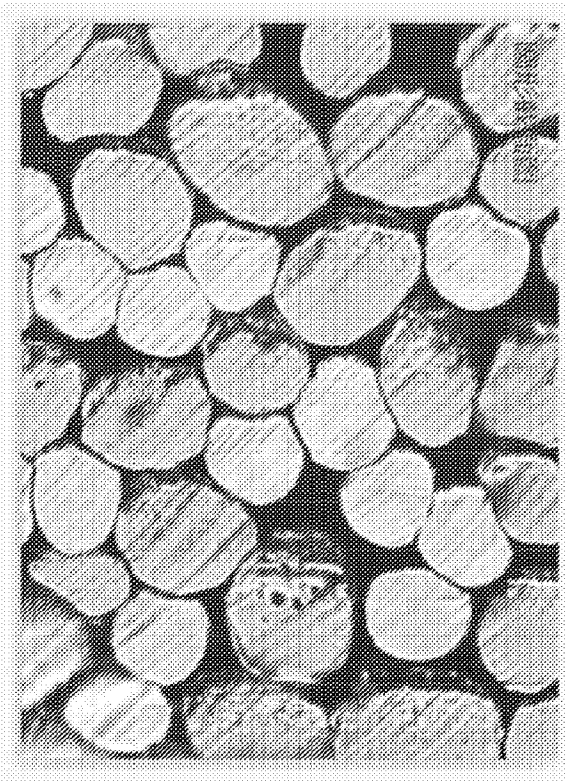
FIG. 6: Microscopic image with 100× magnification of polyester fibers having an O-shaped cross-section.
Figure 7:
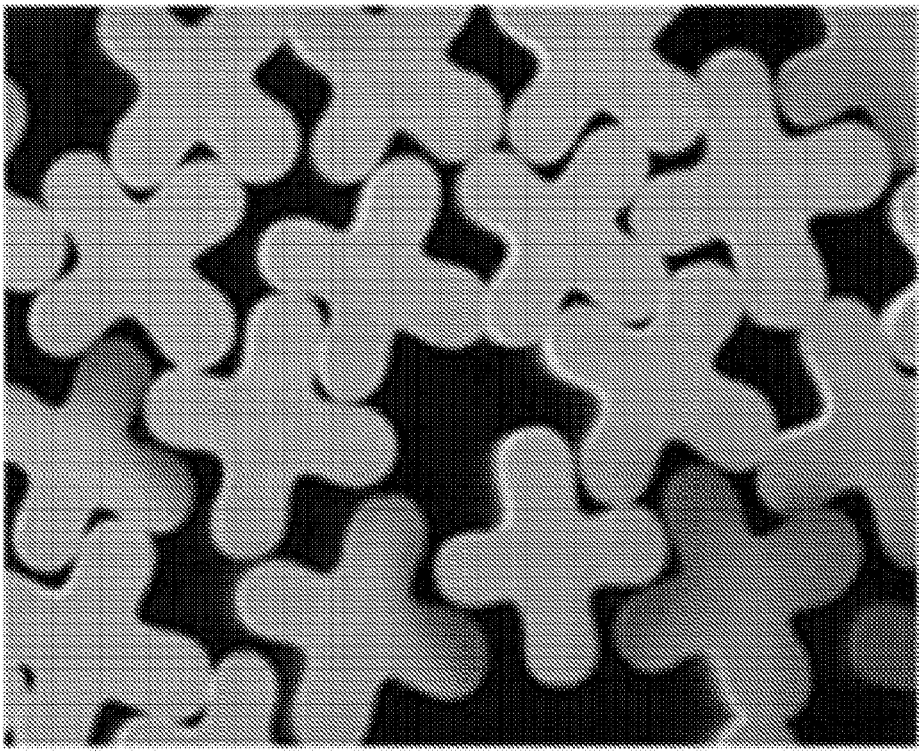
FIG. 7: Microscopic image with 100× magnification of polyester fibers having an X-shaped cross-section.
Figure 8:
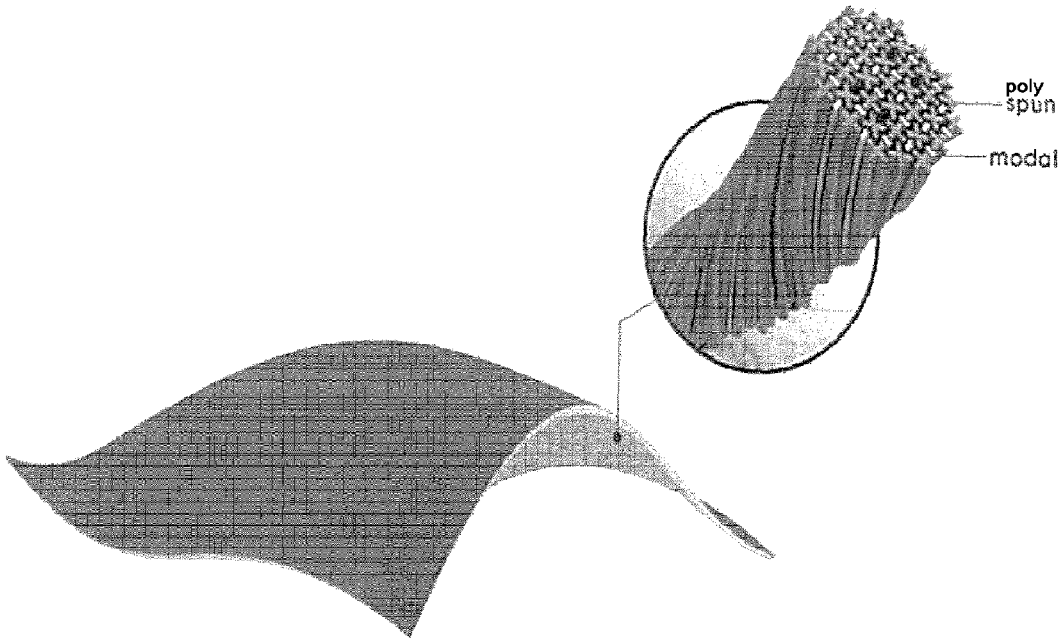
FIG. 8: A cross-section of the fiber blend in accordance with one embodiment of the invention showing the X-shaped cross-section of the polyester fibers.

In one aspect the present invention provides a fabric comprising or consisting of:

- a first yarn comprising a fiber blend of modal and polyester;
- a second yarn comprising spandex; and
- a third yarn comprising polyester.

In some embodiments the first yarn may be a spun yarn. The spun yarn may have between about 10 and about 100 single counts, or between about 20 and about 90 single counts, or between about 30 and about 80 single counts, or between about 40 and about 70 single counts, or between about 50 and about 70 single counts, or between about 55 and about 65 single counts, or about 60 single counts.

The modal may be present in the fiber blend in an amount between about 1% and about 40%, or between about 1% and about 30%, or between about 5% and about 30%, or between about 5% and about 35%, or between about 5% and about 25%, or between about 5% and about 20%, or between about 10% and about 20%, or between about 7.5% and about 20%, or between about 14% and about 18%, or about 16% by weight.

The polyester may be present in the fiber blend in an amount between about 60% and about 99%, or between about 70% and about 99%, or between about 70% and about 95%, or between about 65% and about 95%, or between about 75% and about 95%, or between about 80% and about 95%, or between about 70% and about 90%, or between about 75% and about 90%, or between about 80% and about 90%, or between about 82% and about 86%, or about 84% by weight. The polyester in the fiber blend may be recycled polyester.

In one embodiment the polyester may be present in the fiber blend in an amount between about 70% and about 95% by weight and the modal may be present in the fiber blend in an amount between about 1% and about 30% by weight.

The first yarn may comprise between about 45% and about 75%, or between about 55% and about 65%, or between about 59% and about 61%, or about 60% by weight of the fabric.

In some embodiments the second yarn is a filament yarn, and may comprise, or consist of 100% spandex. Spandex provides elasticity to the fabric. The spandex of the second yarn may be between about 20-denier and about 70-denier, or between about 15-denier and about 45-denier, or between about 15-denier and about 35-denier, or between about 20-denier and about 40-denier, or between about 20-denier and about 30-denier.

The second yarn may comprise between about 4% and about 12%, or between about 2.5% and about 10%, or between about 2.5% and about 7.5%, or about 5% by weight of the fabric.

The third yarn may be a filament yarn, and may comprise or consist of 100% polyester. In some embodiments the polyester of the third yarn may be between about 20-denier and about 80-denier, or between about 30-denier and about 75-denier, or between about 35-denier and about 65-denier, or between about 45-denier and about 55-denier, or between about 47-denier and about 53-denier, or about 50-denier. The polyester may be recycled polyester.

The third yarn may comprise between about 20% and about 50% by weight, or between about 30% and about 40% by weight, or about 35% by weight of the fabric.

The first, second and third yarns may be present as layers. In some embodiments the first yarn may form a bottom layer, the second yarn may form a middle layer and the third yarn may form a top layer. When part of an article of clothing, the bottom layer is intended to be in contact with the skin of a wearer. In some embodiments the polyester of the fiber blend may have a cross-section that is X-shaped, M-shaped, I-shaped, honeycombed-shaped, Y-shaped, U-shaped or O-shaped. These cross-sectional configurations create a plurality of spaces along the length of the first yarn (see FIGS. 1 to 8). The plurality of spaces facilitates a capillary action that is capable of drawing liquid, such as perspiration, from the skin of a wearer along the length of the fibers to the top of the bottom layer. The cross-sectional areas may also maximise the surface area of the fibers thereby lowering the drying time of the fabric. In addition, the air permeability of the fibers may also assist in releasing hot air so as to assist in keeping the wearer fresh and cool. Once the perspiration is moved to the top of the bottom layer it moves through the middle layer and then to the top layer where it is radiated to the environment. In these embodiments, the ordinarily hydrophobic polyester fibers are rendered hydrophilic by altering their cross-sectional structure.

Perspiration present in the space created amongst the polyester fibers may also act as a good heat conductor. As a result, an improved rate of heat extraction is created thereby preventing or minimizing additional perspiration resulting from trapped heat.

Modal is hydrophilic and therefore assists in drawing perspiration from the skin. The presence of modal may also assist entry of perspiration into the spaces created amongst the polyester fibers. The hydrophilic properties of modal may also cause perspiration to be absorbed and dispersed radially outward, thereby wetting a large area of the bottom layer for an increased rate of transportation of perspiration to the top layer. Because modal is highly hydrophilic, only a relatively small amount (about 15% to 20% for example) may be required in the bottom layer to dramatically increase the rate of perspiration removal from skin. Further advantages associated with inclusion of modal are that it can offset the generally sticky feel of polyester so as to provide a soft/silky feel to the wearer and its dull appearance minimizes unwanted heat reflection to the wearer's skin.

When the third yarn is present as the top layer the polyester forms a large outer surface thereby allowing perspiration reaching the outer surface to evaporate efficiently, either by moving air or general evaporation. Another advantage of using polyester as the top layer is that it may be easily decorated by a clothing manufacturer.

Figure 9:
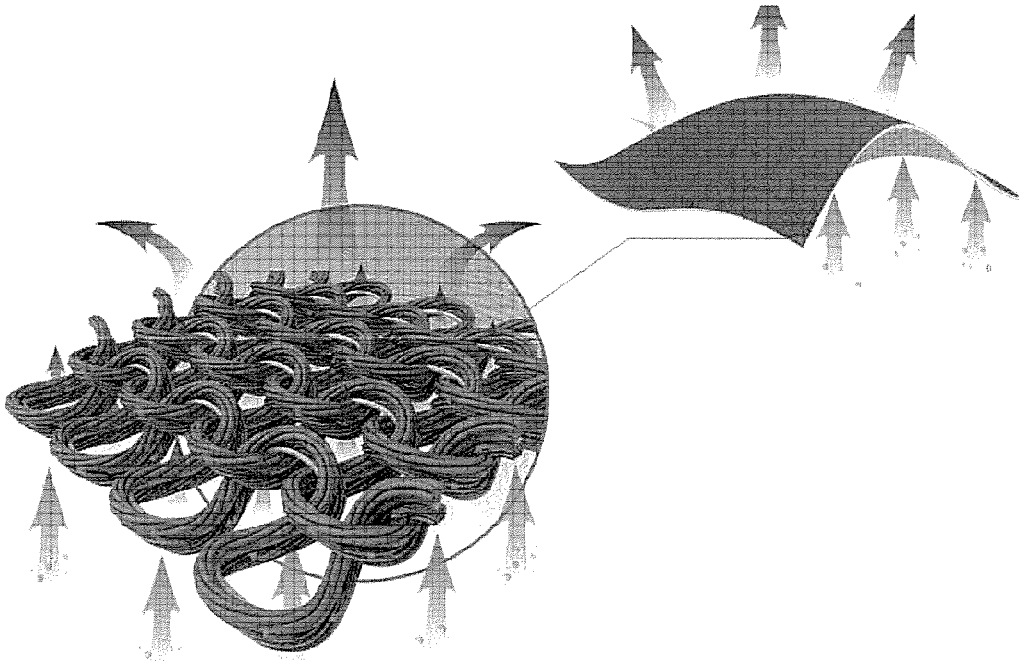
FIG. 9: A knitted fabric in accordance with one embodiment of the invention in which the second yarn is interknitted between the first yarn and the third yarn.

In some embodiments the second yarn may be interknitted between the first yarn and the third yarn (see FIG. 9).

Fabrics in accordance with the invention may be prepared by a three-thread knitting method. In some embodiments, the fabric may be prepared by a method comprising the following steps:

(i) knitting a raw material with a three-thread yarn feeder to obtain a greige fabric comprising the first, second and third yarns;

(ii) performing stenter finishing on the fabric knitted in (i) at, for example, a machine speed of about 20 to 25 yards and at a temperature of about 190° C. to about 200° C.;

(iii) dyeing the fabric obtained following step (ii), followed by dewatering and drying through a flat-width fabric dryer; and (iv) performing stenter finishing of the fabric obtained following step (iii) at, for example, a machine speed of about 18 yards to 22 yards and at a temperature of about 145° C. to about 155° C. so as to obtain a finished fabric product.

EXAMPLES

Example 1: Preparation of a Three Layer, Tri-Knit Pique Fabric

A three layer, tri-knit pique fabric having the following composition was prepared:

A top yarn which is a filament yarn made of 50-denier 100% polyester

A middle yarn which is a filament yarn made of 30-denier 100% spandex

A bottom yarn which is a spun yarn of 60 single counts made of a fiber blend comprising 16% by weight modal and 84% by weight polyester, wherein the polyester has an X-shaped cross-section.

The top yarn is 35% by weight of the fabric, the middle yarn is 5% by weight of the fabric and the bottom yarn is 60% by weight of the fabric.

The fabric consists of 86% polyester, 9% modal and 5% spandex.

The method used to prepare the fabric was as per that described above.

Figure 10:
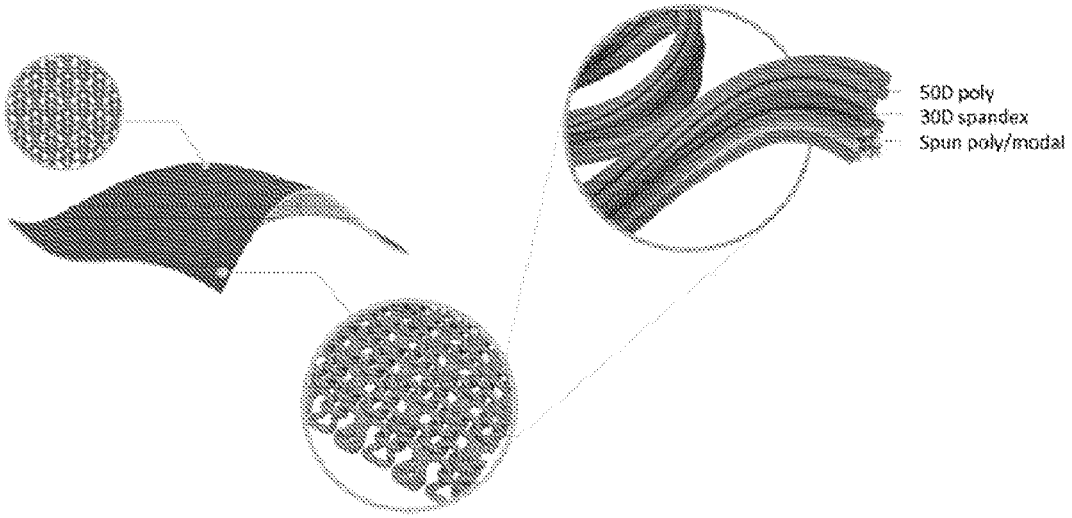
FIG. 10: A three layer tri-knit pique fabric in accordance with one embodiment of the invention.
Figure 11:
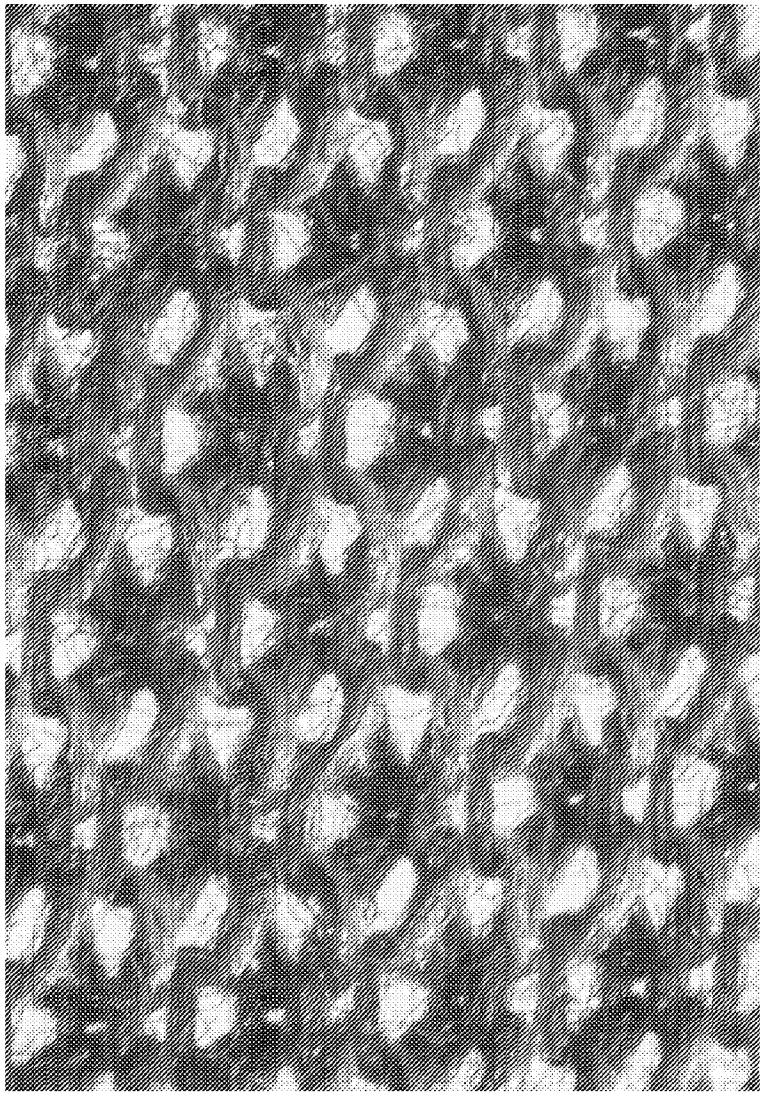
FIG. 11: Microscopic image with 100× magnification of a three layer, tri-knit pique fabric in accordance with one embodiment of the invention.

The structure of the fabric is illustrated in FIGS. 10 and 11.

The water vapour resistance (ISO 11092:2014) of the fabric was tested according to the particulars shown below in Table 1:

TABLE 1

| Fabric conditioning | Parameter | Water vapour resistance |
|---|---|---|
| | Air temperature | 35 ± 0.1° C. |
| | Relative humidity | 40 ± 3% |
| | Conditioning duration | At least 12 hours (fabric ≤ 5 mm thick) |
| Test conditions | Air temperature | 35 ± 0.1° C. |
| | Relative humidity | 40 ± 3% |
| | Air speed | 1.0 ± 0.1 m/s (horizontal air flow over fabric surface) |
| | Temperature of hot plate | 35 ± 0.1° C. |
| | Orientation of test fabric | Fabric lied flat across measurement unit with the side intended to be in contact with the body facing towards the measurement unit |

The results are presented below in Table 2:

TABLE 2

| Fabric specimen | Water vapour resistance ($R_{et}$) |
|---|---|
| 1 | 2.57 ($m^2 \cdot Pa$)/W |
| 2 | 2.56 ($m^2 \cdot Pa$)/W |
| 3 | 2.61 ($m^2 \cdot Pa$)/W |
| Mean | 2.58 ($m^2 \cdot Pa$)/W |

The drying time of the fabric was determined using American Association of Textile Chemists (AATCC) 199-2013 and the results are shown below in Table 3:

TABLE 3

| Fabric | Average drying time |
|---|---|
| Original | 188 minutes |
| After 30 washes | 192 minutes |

The vertical wicking capability of the fabric was determined using AATCC 197, Option B and the results are shown below in Table 4:

TABLE 4

| Fabric | Average vertical wicking rate (inches/10 min.) |
|---|---|
| Original lengthwise | 4.8 |
| Original widthwise | 4.5 |
| After 30 washes lengthwise | 5.3 |
| After 30 washes widthwise | 5.2 |

The absorbency of the fabric was determined using AATCC 79-14 and the results are shown below in Table 5:

TABLE 5

| Fabric | Wetting time (seconds) |
|---|---|
| Original | 1.0 |
| After 30 washes | 1.0 |

Example 2: Preparation of a Three Layer, Tri-Knit Single Jersey Fabric

A three layer, tri-knit single jersey fabric having the following composition was prepared:

A top yarn which is a filament yarn made of 50-denier 100% polyester

A middle yarn which is a filament yarn made of 20-denier 100% spandex

A bottom yarn which is a spun yarn of 60 single counts made of a fiber blend comprising 16% by weight modal and 84% by weight polyester, wherein the polyester has an X-shaped cross-section.

The top yarn is 35% by weight of the fabric, the middle yarn is 5% by weight of the fabric and the bottom yarn is 60% by weight of the fabric.

The fabric consists of 86% polyester, 9% modal and 5% spandex.

The method used to prepare the fabric was as per that described above.

Figure 12:
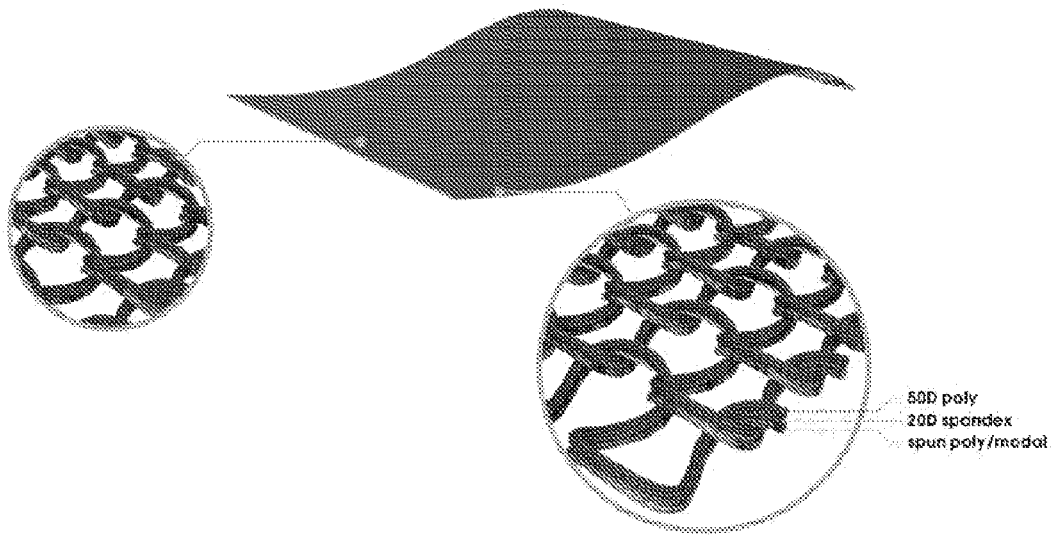
FIG. 12: A three layer, tri-knit single jersey fabric in accordance with one embodiment of the invention.
Figure 13:
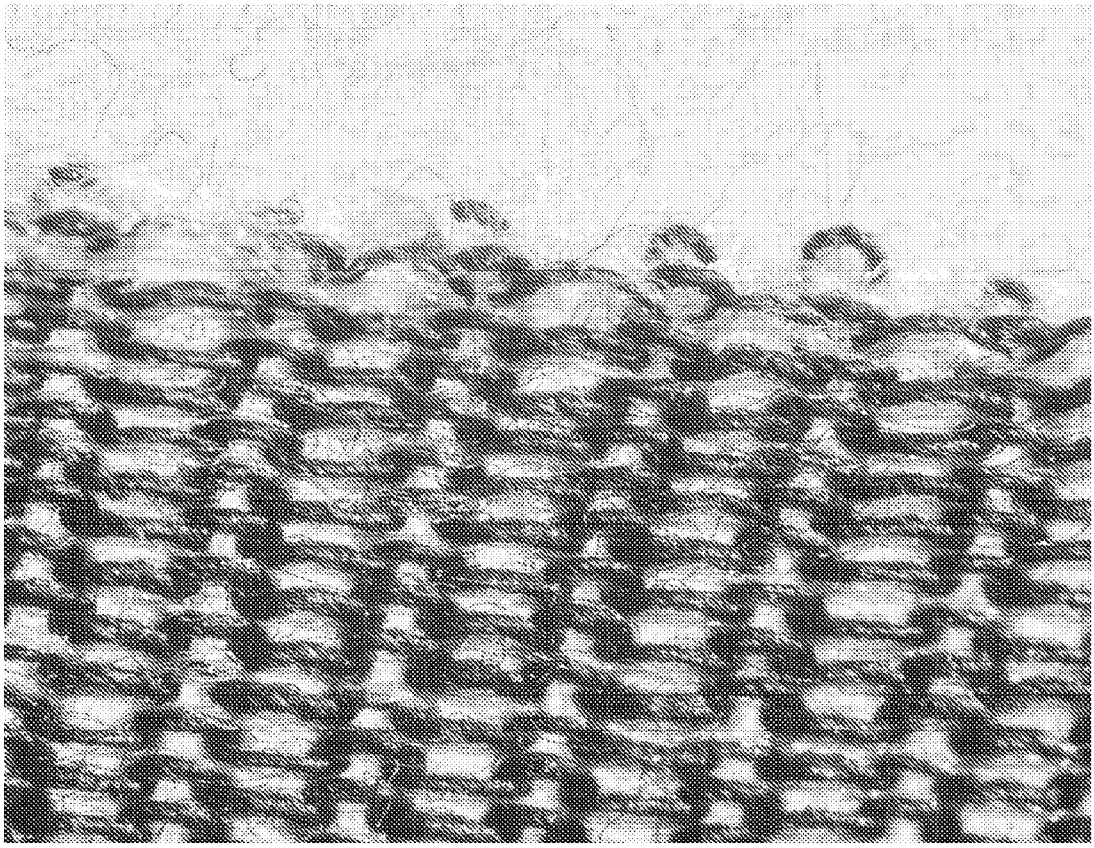
FIG. 13: Microscopic image with 100× magnification of a three layer, tri-knit single jersey fabric in accordance with one embodiment of the invention.

The structure of the fabric is illustrated in FIGS. 12 and 13.

The water vapour resistance (ISO 11092:2014) of the fabric was tested according to the parameters shown above in Table 1. The results are presented below in Table 6:

TABLE 6

| Fabric specimen | Water vapour resistance (Ret) |
|---|---|
| 1 | 2.149 ($m^2 \cdot Pa$)/W |
| 2 | 2.028 ($m^2$ . Pa)/W |
| 3 | 2.037 ($m^2 \cdot Pa$)/W |
| Mean | 2.071 ($m^2 \cdot Pa$)/W |

The drying time of the fabric was determined using AATCC 199-2013 and the results are shown below in Table 7:

TABLE 7

| Fabric | Average drying time |
|---|---|
| Original | 145.9 minutes |
| After 30 washes | 157.0 minutes |

The vertical wicking capability of the fabric was determined using AATCC 197, Option B and the results are shown below in Table 8:

TABLE 8

| Fabric | Average vertical wicking rate (inches/10 min.) |
|---|---|
| Original lengthwise | 5.0 |
| Original widthwise | 5.0 |
| After 30 washes lengthwise | 5.3 |
| After 30 washes widthwise | 4.9 |

The absorbency of the fabric was determined using AATCC 79-14 and the results are shown below in Table 9:

TABLE 9

| Fabric | Wetting time (seconds) |
|---|---|
| Original | 1.0 |
| After 30 washes | 1.0 |

The absorbency, drying time, vertical wicking and water vapour resistance of the fabric was compared to a commonly used 100% polyester knitted quick-dry jersey manufactured by Nike. The results of each test are summarised in Table 10.

TABLE 10

| | Fabric | |
|---|---|---|
| Test | Present invention | Nike |
| Absorbency (AATCC 79-14) | Original 1 second | Original 1 second |
| Drying Time (AATCC 199-2013) | Original 145.9 mins | Original 181 mins |
| Vertical Wicking (AATCC 197, OPTION B) | Lengthwise: original 5.0 inch/10 mins Widthwise: original 5.0 inch/10 mins | Lengthwise: original 3.8 inch/10 mins Widthwise: original 4.1 inch/10 mins |
| Water-Vapour Resistance (ISO 11092:2014) | Arithmetic Mean: 2.071 ($m^2 \cdot Pa$)/W | Arithmetic Mean: 2.26 ($m^2 \cdot Pa$)/W |

The water-vapour resistance test was conducted as set out in Table 11.

TABLE 11

| | | |
|---|---|---|
| Specimen Conditioning | Parameters | Water-Vapour Resistance |
| | Air Temperature | (35 ± 0.1)° C. |
| | Relative Humidity | (40 ± 3) % |
| | Conditioning Duration | 12 Hours (Specimen ≤ 5 mm Thick) |
| Test Condition | Test | Water-Vapour Resistance |
| | Air Temperature | (35 ± 0.1)° C. |
| | Relative Humidity | (40 ± 3) % |
| | Air Speed | (1.0 ± 0.1) m/s (Horizontal Air Flow Over The Surface Of The Fabric) |
| | Temperature Of Hot Plate | (35 ± 0.1)° C. |
| | Orientation Of Test Specimen | Specimen Lied Flat Across The Measurement Until With The Side Normally Facing The Human Body Towards The Measuring Unit. |

It will be seen from the results in Table 10 that the fabric of the present invention is quicker drying, provides better wicking and less vapour resistance compared to the Nike jersey.

The absorbency and the wicking of the fabric was also compared to the commonly used CLIMACHILL fabric manufactured by Adidas. The results are summarised in Table 12. It will be seen that the fabric of the present invention provides excellent absorbency and wicking, including after multiple washes.

TABLE 12

| Test | | Fabric of present invention | Adidas Climachill |
|---|---|---|---|
| Absorbency (AATCC 79-14) | Original | FACE < 1 seconds | FACE < 1 seconds |
| | Original | BACK < 1 seconds | BACK < 1 seconds |
| | After 5 washes without detergent | FACE < 1 seconds | FACE 11.28 seconds |
| | After 5 washes without detergent | BACK < 1 seconds | BACK 26.43 seconds |
| | After 10 washes without detergent | FACE < 1 seconds | FACE 12.16 seconds |
| | After 10 washes without detergent | BACK < 1 seconds | BACK 27.15 seconds |
| Vertical Wicking (AATCC 197, OPTION B) | Original | lengthwise 95 mm | lengthwise 76 mm |
| | Original | widthwise 80 mm | widthwise 99 mm |
| | After 5 washes without detergent | lengthwise 107 mm | lengthwise 10 mm |
| | After 5 washes without detergent | widthwise 109 mm | widthwise 15 mm |
| | After 10 washes without detergent | lengthwise 86 mm | lengthwise 18 mm |
| | After 10 washes without detergent | widthwise 101 mm | widthwise 27.5 mm |

Example 3: Preparation of a Three Layer, Tri-Knit Pointelle Fabric

A three layer, tri-knit pointelle fabric having the following composition was prepared:

- A top yarn which is a filament yarn made of 50-denier 100% polyester
- A middle yarn which is a filament yarn made of 20-denier 100% spandex
- A bottom yarn which is a spun yarn of 60 single counts made of a fiber blend comprising 16% by weight modal and 84% by weight polyester, wherein the polyester has an X-shaped cross-section.
- The top yarn is 34.5% by weight of the fabric, the middle yarn is 5% by weight of the fabric and the bottom yarn is 60.5% by weight of the fabric.
- The fabric consists of 85% polyester, 10% modal and 5% spandex.

The method used to prepare the fabric was as per that described above.

Figure 14:
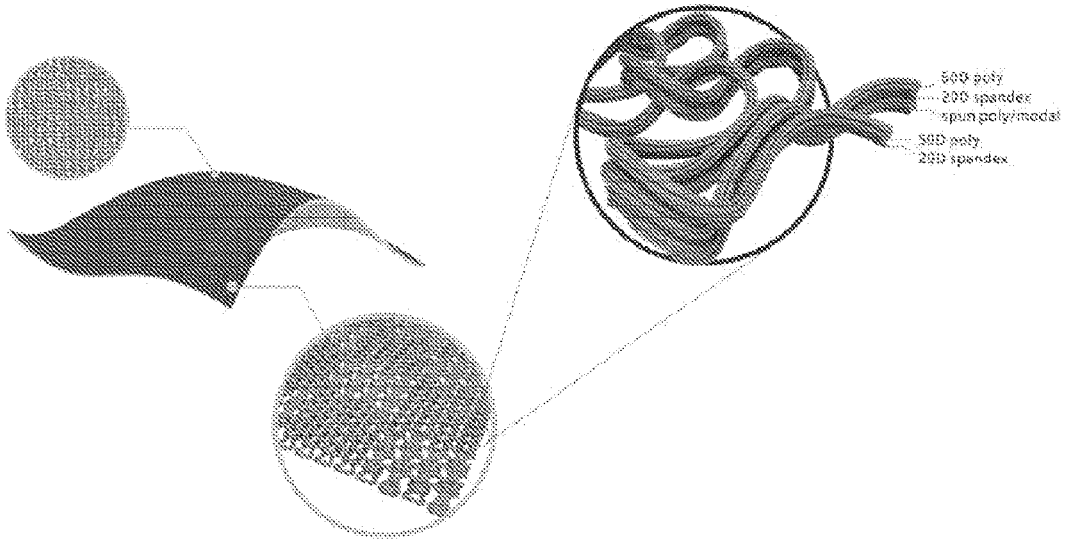
FIG. 14: A three layer, tri-knit pointelle fabric in accordance with one embodiment of the invention.
Figure 15:
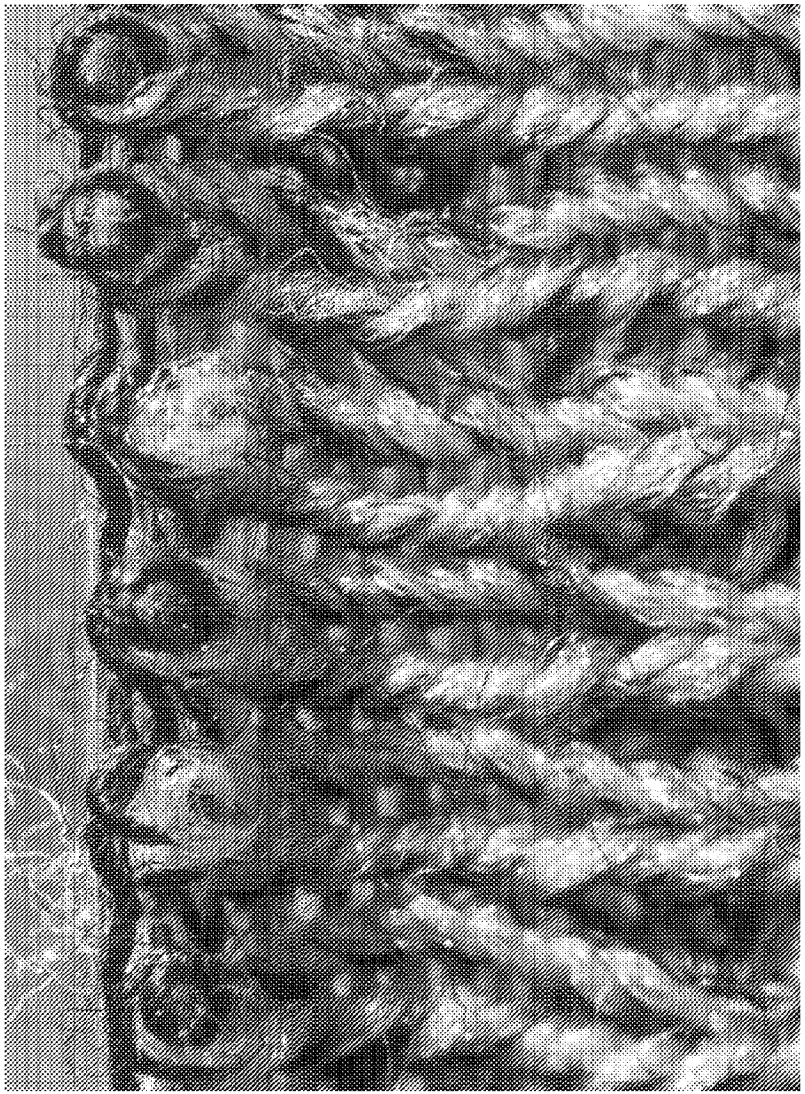
FIG. 15: Microscopic image with 100× magnification of a three layer, tri-knit pointelle fabric in accordance with one embodiment of the invention.

The structure of the fabric is illustrated in FIGS. 14 and 15.

The water vapour resistance (ISO 11092:2014) of the fabric was tested according to the parameters shown above in Table 1. The results are presented below in Table 13:

TABLE 13

| Fabric specimen | Water vapour resistance (Ret) |
|---|---|
| 1 | 2.53 ($m^2 \cdot Pa$)/W |
| 2 | 2.56 ($m^2 \cdot Pa$)/W |
| 3 | 2.61 ($m^2 \cdot Pa$)/W |
| Mean | 2.57 ($m^2 \cdot Pa$)/W |

The drying time of the fabric was determined using AATCC 199-2013 and the results are shown below in Table 14:

TABLE 14

| Fabric | Average drying time |
|---|---|
| Original | 184 minutes |
| After 30 washes | 190 minutes |

The vertical wicking capability of the fabric was determined using AATCC 197, Option B and the results are shown below in Table 15:

TABLE 15

| Fabric | Average vertical wicking rate (inches/10 min.) |
|---|---|
| Original lengthwise | 4.3 |
| Original widthwise | 4.4 |
| After 30 washes lengthwise | 5.7 |
| After 30 washes widthwise | 5.4 |

The absorbency of the fabric was determined using AATCC 79-14 and the results are shown below in Table 16:

TABLE 16

| Fabric | Wetting time (seconds) |
|---|---|
| Original | 1.0 |
| After 30 washes | 1.0 |

Example 4: Preparation and Functional Characteristics of a Three-Layer, Tri-Knit Jersey Fabric A three-layer, tri-knit jersey fabric having the following composition was prepared:

- A top yarn which is a filament yarn made of 50-denier and 36-hole (36F) 100% recycled polyester. The top yarn accounts for 30.4% by weight of the fabric.
- A middle yarn which is a filament yarn made of 20-denier 100% spandex. The middle yarn accounts for 4.7% by weight of the fabric.
- A bottom yarn which is a spun yarn of 50 single counts (50s) made of a fiber blend comprising 9% by weight of modal and 91% by weight of O-shaped cross-sectioned wicked recycled polyester. The bottom yarn accounts for 64.9% by weight of the fabric. It will be understood that, apart from an O-shaped cross section, different shapes of recycled polyester cross section may be adopted, e.g., M-shaped, I-shaped, Honeycomb-shaped, Y-shaped, U-shaped etc.

The fabric consists of 89% recycled polyester, 6% modal and 5% spandex.

Figure 16:
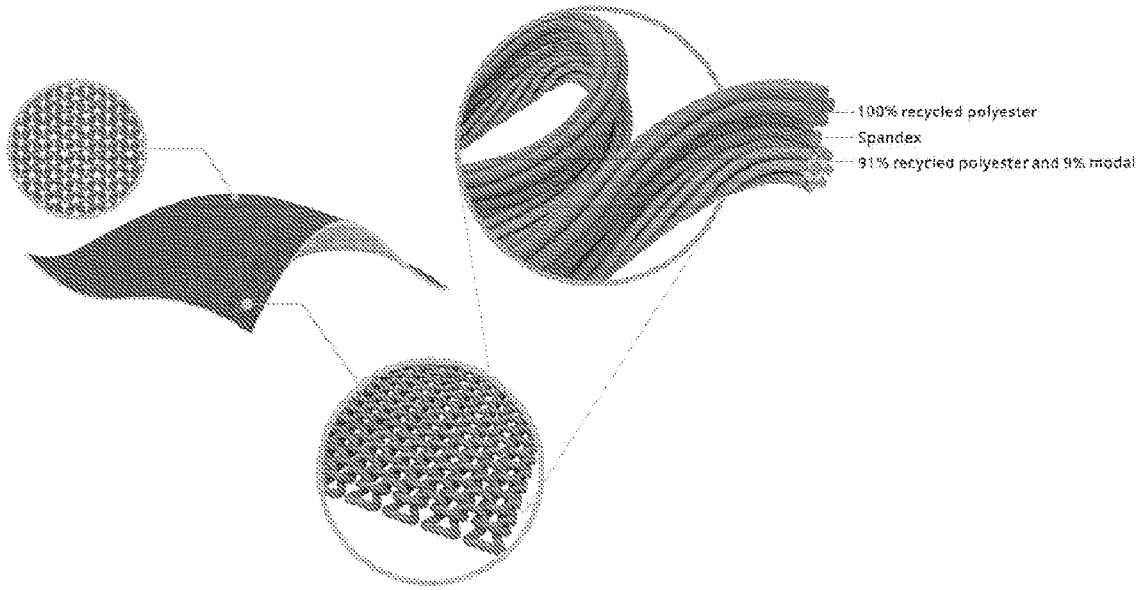
FIG. 16: Diagrammatic representation of one embodiment of a three-layer, tri-knit jersey fabric according to the present invention.
Figure 17:
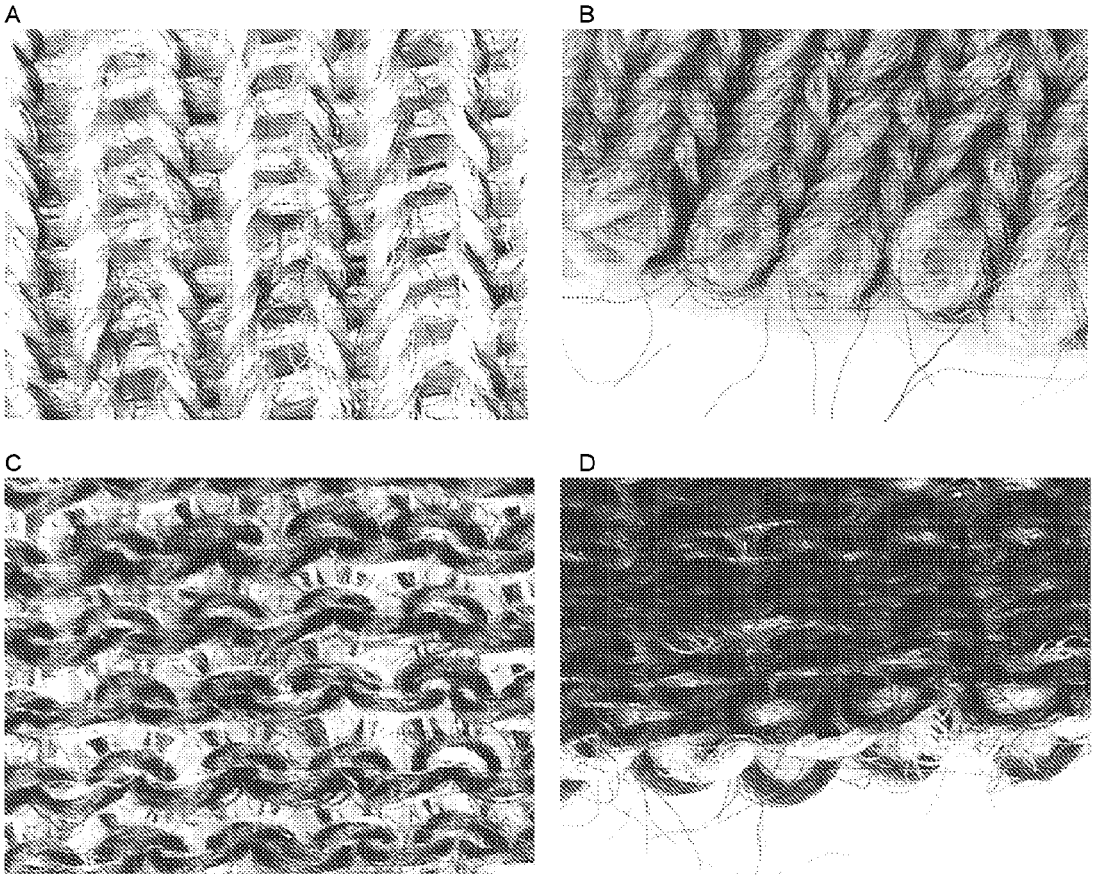
FIG. 17: Microscopic images of one embodiment of a three-layer, tri-knit jersey fabric according to the present invention. (A) Front surface. (B) Edge of front surface. (C) Back surface. (D) Edge of back surface.

The method used to prepare the fabric was as per that described above. The structure of the fabric is illustrated in FIGS. 16 and 17.

Water vapour resistance was tested in accordance with ISO 11092:2014 as set out in Table 17. The mean water vapour resistance ($R_{et}$) of the fabric was measured to be 3.69 ($m^2 \cdot Pa$)/W.

TABLE 17

| | |
|---|---|
| Air temperature | 35.0 ± 0.1° C. |
| Relative humidity | 40 ± 3% |
| Air speed | 1.0 ± 0.05 m/s |
| Temperature of hotplate | 35.0 ± 0.1° C. |
| Orientation of test specimen | Specimens lay flat across the measurement unit with the surface intended to face the human body towards the measuring unit. Fabric back surface (skin contact surface) was in contact with hotplate. |

The drying time of the fabric was determined in accordance with AATCC TM 199-2018 (Drying temperature 37° C. End point: to the original dry weight of a specimen; measured at 20° C., 65% RH). The results are set out in Table 18.

TABLE 18

| | |
|---|---|
| Ave. absorbency time of face | 0 s |
| Ave. absorbency time of back | 0 s |

TABLE 18-continued

| | |
|---|---|
| Ave. dry weight: W1 | 0.623 g |
| Ave. wet weight: W2 | 1.916 g |
| Ave. moisture retention | 207.5% |
| Ave. amount of water applied | 1.29 mL |
| Ave. average drying time | 35 min |

The vertical wicking capability of the fabric was determined in accordance with AATCC 197-2018, Option B. The face side of the fabric was tested, and the results are set out in Table 19.

TABLE 19

| | | #1 | #2 | #3 | Average | Wicking rate (mm/s) |
|---|---|---|---|---|---|---|
| Given time 2 min | Lengthwise (mm) | 77 | 77 | 78 | 77 | 0.64 |
| | Widthwise (mm) | 68 | 68 | 67 | 68 | 0.56 |
| Given time 10 min | Lengthwise (mm) | 129 | 130 | 129 | 129 | 0.22 |
| | Widthwise (mm) | 116 | 116 | 115 | 116 | 0.19 |

The absorbency of the fabric was determined in accordance with AATCC TM 79-2018 and, on average, the water drop disappeared almost immediately.

It will be understood that the tri-knit fabric may comprise different compositions and sizes, including those set out in Table 20.

TABLE 20

| Alternative example | Top yarn size | Top yarn % by weight | Middle yarn size | Middle yarn % by weight | Bottom yarn size | Bottom yarn % by weight | Composition |
|---|---|---|---|---|---|---|---|
| i | 30D | 24.5% | 20D | 5.4% | 60S | 70.1% | 89% recycled polyester, 6% modal, 5% spandex |
| ii | 50D | 34.2% | 30D | 6.9% | 60S | 58.9% | 88% recycled polyester, 5% modal, 7% spandex |
| iii | 75D | 39.2% | 40D | 7.0% | 50S | 53.8% | 88% recycled polyester, 5% modal, 7% spandex |

Although the invention has been described with reference to specific embodiments, it will be appreciated by those skilled in the art that the invention may be embodied in many other forms.

The invention claimed is:

1. A fabric comprising:

a first yarn comprising a fiber blend of modal and polyester, the modal being present in the fiber blend in an amount between about 5% and about 25% by weight, the polyester being present in the fiber blend in an amount between about 75% and about 95% by weight, the first yarn forming a bottom layer of the fabric that removes perspiration from a wearer by contact with the wearer's skin in use;

a second yarn comprising spandex, the second yarn forming a middle layer of the fabric; and a third yarn consisting of 100% polyester, the third yarn forming a top outer layer of the fabric to evaporate the perspiration removed from the wearer's skin, wherein the polyester in the fiber blend has a cross-section that creates a plurality of spaces along the length of the first yarn that facilitate a capillary action, wherein the first yarn comprises between about 45% and about 75% by weight of the fabric, and wherein the third yarn comprises between about 20% and about 50% by weight of the fabric, and wherein the fabric has a water vapour resistance in the range 2.071-2.58 ($m^2$·Pa)/W when tested according to ISO 11092:2014, drying time in the range 145.9-192 minutes when tested according to (AATCC) 199-2013, and a vertical wicking rate in the range 4.3-5.7 (inches/10 minutes) when tested according to (AATCC) 197, Option B.

2. The fabric of claim 1, wherein the first yarn consists of a fiber blend of modal and polyester.

3. The fabric of claim 1, wherein the first yarn is a spun yarn.

4. The fabric of claim 1, wherein the spun yarn is a spun yarn of 50 or 60 single counts.

5. The fabric of claim 1, wherein the polyester is present in the fiber blend in an amount between about 80% and about 90% by weight, and the modal is present in the fiber blend in an amount between about 10% and about 20% by weight.

6. The fabric of claim 5, wherein the polyester is present in the fiber blend in an amount of about 84% by weight and the modal is present in the fiber blend in an amount of about 16% by weight.

7. The fabric of claim 1, wherein the polyester in the fiber blend has a cross-section that is X-shaped, M-shaped, I-shaped, honeycomb-shaped, Y-shaped, U-shaped or O-shaped, thereby creating a plurality of spaces along the length of the first yarn that facilitate a capillary action.

8. The fabric of claim 7, wherein the polyester in the fiber blend has a cross-section that is X-shaped thereby creating a plurality of spaces along the length of the first yarn that facilitate a capillary action.

9. The fabric of claim 1, wherein the modal in the fiber blend has a cross-section that is substantially rectangular.

10. The fabric of claim 1, wherein the polyester and modal in the fiber blend are of staple length.

11. The fabric of claim 1, wherein the first yarn comprises about 60% to 61% by weight of the fabric.

12. The fabric of claim 1, wherein the second yarn is a filament yarn.

13. The fabric of claim 1, wherein the second yarn comprises or consists of 100% spandex.

14. The fabric of claim 1, wherein the spandex of the second yarn is between about 20-denier and about 70-denier.

15. The fabric of claim 14, wherein the spandex of the second yarn is between about 20-denier and about 30-denier.

16. The fabric of claim 15, wherein the spandex of the second yarn is about 20-denier or about 30-denier.

17. The fabric of claim 1, wherein the second yarn comprises between about 4% and about 12% by weight of the fabric.

18. The fabric of claim 17, wherein the second yarn comprises about 5% by weight of the fabric.

19. The fabric of claim 1, wherein the third yarn is a filament yarn.

20. The fabric of claim 1, wherein the polyester of the third yarn is between about 20-denier and about 80-denier.

21. The fabric of claim 20, wherein the polyester of the third yarn is 50-denier.

22. The fabric of claim 1, wherein the third yarn comprises about 34% to 35% by weight of the fabric.

23. The fabric of claim 1, wherein the second yarn is inter-knitted between the first yarn and the third yarn.

24. The fabric of claim 1, wherein the fabric consists of three layers.

25. The fabric of claim 1, wherein the fabric is selected from the group consisting of: a single jersey, pique, a pointelle, double knit, jacquard or terry.

26. A fabric comprising:

a bottom yarn which is a spun yarn of 60 single counts comprising or consisting of a fiber blend of about 16% by weight modal and about 84% by weight polyester and removes perspiration from a wearer by contact with the wearer's skin in use;

a middle yarn which is a filament yarn comprising or consisting of 20-denier 100% spandex; and a top yarn which is a filament yarn comprising or consisting of 50-denier 100% polyester to evaporate the perspiration removed from the wearer's skin, and wherein the polyester in the fiber blend has a cross-section that is X-shaped, M-shaped, I-shaped, honeycomb-shaped, Y-shaped, U-shaped or O-shaped, thereby creating a plurality of spaces along the length of the bottom yarn that facilitates a capillary action, wherein the first yarn comprises between about 45% and about 75% by weight of the fabric, and wherein the third yarn comprises between about 20% and about 50% by weight of the fabric, and wherein the fabric has a water vapour resistance in the range 2.071-2.58 ($m^2$·Pa)/W when tested according to ISO 11092:2014, drying time in the range 145.9-192 minutes when tested according to (AATCC) 199-2013, and a vertical wicking rate in the range 4.3-5.7 (inches/10 minutes) when tested according to (AATCC) 197, Option B.

27. The fabric of claim 26, wherein the polyester in the fiber blend has an X-shaped cross-section thereby creating a plurality of spaces along the length of the bottom yarn that facilitates a capillary action.

28. The fabric of claim 26, wherein the top yarn comprises about 35% by weight of the fabric, the middle yarn comprises about 5% by weight of the fabric, and the bottom yarn comprises about 60% by weight of the fabric.

29. A fabric comprising:

a bottom yarn which is a spun yarn of 60 single counts comprising or consisting of a fiber blend of about 16% by weight modal and about 84% by weight polyester and removes perspiration from a wearer by contact with the wearer's skin in use;

a middle yarn which is a filament yarn comprising or consisting of 30-denier 100% spandex; and a top yarn which is a filament yarn comprising or consisting of 50-denier 100% polyester to evaporate the perspiration removed from the wearer's skin, and wherein the polyester in the fiber blend has a cross-section that is X-shaped, M-shaped, I-shaped, honeycomb-shaped, Y-shaped, U-shaped or O-shaped, thereby creating a plurality of spaces along the length of the bottom yarn that facilitates a capillary action, wherein the first yarn comprises between about 45% and about 75% by weight of the fabric, and wherein the third yarn comprises between about 20% and about 50% by weight of the fabric, and wherein the fabric has a water vapour resistance in the range 2.071-2.58 ($m^2 \cdot Pa$)/W when tested according to ISO 11092:2014, drying time in the range 145.9-192 minutes when tested according to (AATCC) 199-2013, and a vertical wicking rate in the range 4.3-5.7 (inches/10 minutes) when tested according to (AATCC) 197, Option B.

30. The fabric of claim 29, wherein the polyester in the fiber blend has an X-shaped cross-section thereby creating a plurality of spaces along the length of the bottom yarn that facilitates a capillary action.

31. The fabric of claim 29, wherein the top yarn comprises about 35% by weight of the fabric, the middle yarn comprises about 5% by weight of the fabric, and the bottom yarn comprises about 60% by weight of the fabric.

32. The fabric of claim 29, which is a pique.

33. The fabric of claim 29, wherein the top yarn comprises about 34.5% by weight of the fabric, the middle yarn comprises about 5% by weight of the fabric, and the bottom yarn comprises about 60.5% by weight of the fabric.

34. The fabric of claim 29, which is a pointelle.

35. An article of clothing or a home textile when produced from the fabric of claim 1.

36. The article of clothing or home textile of claim 35, wherein the clothing is a shirt, singlet, jersey, pyjamas, maillot, fleece, shorts, pants, hood, running hat, skull cap, helmet liner, mask, headband or sock.

37. The article of clothing or home textile of claim 35, wherein the home textile is a towel, bedding, cushion, sofa or furniture.

* * * * *